US006131367A

United States Patent [19]

Fukuda et al.

[11] Patent Number: 6,131,367

[45] Date of Patent: Oct. 17, 2000

[54] PACKAGING MACHINE WITH IMPROVED FORMER UNIT ATTACHMENT

[75] Inventors: Masao Fukuda; Michihiro Kubo, both of Shiga, Japan

[73] Assignee: Ishida Co., Ltd., Kyoto, Japan

[21] Appl. No.: 09/300,154

[22] Filed: Apr. 27, 1999

[30] Foreign Application Priority Data

May 11, 1998 [JP] Japan ..... 10-127405

[51] Int. Cl.[7] ..... B65B 9/20

[52] U.S. Cl. ..... 53/201; 53/551; 493/302

[58] Field of Search ..... 53/201, 551, 552; 493/302

[56] References Cited

U.S. PATENT DOCUMENTS

| | | | |
|---|---|---|---|
| 3,296,770 | 1/1967 | Wilson . | |
| 3,486,424 | 12/1969 | Tanner | 493/302 |
| 5,537,798 | 7/1996 | Fukuda et al. | 53/201 |
| 5,707,329 | 1/1998 | Pool et al. . | |
| 5,715,656 | 2/1998 | Pearce | 53/551 |
| 6,044,615 | 4/2000 | Fukuda | 53/201 |

*Primary Examiner*—John Sipos

*Attorney, Agent, or Firm*—Majestic, Parsons, Siebert & Hsue P.C.

[57] ABSTRACT

A form-fill-seal packaging machine has not only the basic elements such as devices for transporting a film and longitudinally and transversely sealing it but also a former and a chute formed integrally together as a former unit which is made detachably attachable to the frame structure of the packaging machine by an attachment mechanism. The former unit has wedge-shaped members, and the attachment mechanism includes a mobile member constrained to move linearly and a lever which is attached to the frame structure such that a one-touch operation to rotate this lever causes this mobile member to move towards or away from the wedge-shaped members on the former unit and to engage with them or disengage from them.

7 Claims, 8 Drawing Sheets

PACKAGING MACHINE WITH IMPROVED FORMER UNIT ATTACHMENT

BACKGROUND OF THE INVENTION

This invention relates to a form-fill-seal type packaging machine for producing packaged products by bending an elongated bag-making material into a tubular form by means of a former unit while dropping articles to be packaged into the tubularly formed material.

A packaging machine of this kind, for producing bags filled with potato chips, for example, is typically structured such that an elongated bag-making material (the "film") is unwound from a roll and transported downward while it is bent into a tubular form, articles to be packaged are dropped in after the bottom edge of this tubularly formed film is transversely sealed, and the top edge is also transversely sealed thereafter to produce a bag with articles sealed inside. Such a packaging machine is usually provided with a former for guiding the film in a specified direction while bending it such that both its longitudinal edge parts overlap one on top of the other and a chute through which articles to be packaged are dropped into the tubularly formed film after its bottom edge is transversely sealed. Prior art packaging machines, however, were designed to produce bags of only a specified size. If it is desired to produce bags of different sizes by using such a prior art packaging machine, it is necessary to exchange both the former and the chute. Since the former and the chute are normally required to be exchanged separately, the work of exchanging the former and the chute has been a cumbersome process, adversely affecting the work efficiency.

In view of the above, it has been known to unify the former and the chute such that the work of exchanging them can be made simpler and the packaging work efficiency can be improved.

A method of and a mechanism for attaching a prior art former unit will be explained next with reference to FIG. 9, wherein numeral 301 indicates a former unit to be attached to a main frame X of the packaging machine. The former unit 301 comprises a base member 302, columnar members 303 standing up at both side regions of the base member 302 and brackets 304 which are attached to the upper ends of the columnar members 303, extending horizontally for supporting a chute 305 nearly at the center of the base member 302. A former 306 is attached at a position somewhat below where the chute 305 is supported by the brackets 304 so as to surround the chute 305. The base member 302 has two notches 307 formed therein, and the main frame X of the packaging machine is provided with screw holes (not shown) at corresponding positions such that the former unit 301 can be fastened to the main frame X by matching the notches 307 in the base member 302 with these holes and inserting levered screws 308 in them and tightening.

The method and mechanism of the prior art technology described above were not satisfactory because there was the possibility of the screws 308 becoming loose during the course of operation of the packaging machine such that accurate bag-making operation could not be continued. Since two screws must be loosened and then tightened for each exchange operation, furthermore, this prior art technology was unsatisfactory also from the point of view of work efficiency.

SUMMARY OF THE INVENTION

It is therefore an object of this invention to provide a packaging machine with an improved former unit which can be removed from and attached to a base member of the packaging machine more easily in a one-touch operation such that the work efficiency of the packaging machine as a whole can be improved.

A packaging machine embodying this invention, with which the above and other objects can be accomplished, may be characterized not only as comprising the basic elements of a prior art form-fill-seal packaging machine such as means for transporting a film and longitudinally and transversely sealing it but also as having its former and chute together as a former unit in an integrated form and being provided with an attachment mechanism for detachably attaching this former unit to the frame structure of the machine. The attachment mechanism includes a wedge-shaped member attached to the former unit, a mobile member and a lever which is attached to the frame structure (in the sense that the lever is adapted to rotate around an axis which is fixed with respect to the frame structure of the machine) such that this mobile member can be moved by a one-touch operation on the lever to thereby rotate it and the mobile member will engage or disengage with the wedge-shaped member to thereby fasten the former unit to the frame structure or release it from the fastened condition. Such a mechanism may be embodied by way of a cam mechanism, a cam plate with a spirally shaped groove being attached to the frame structure and a cam follower adapted to move along this groove being secured to the mobile member such that the rotary motion of the cam plate occasioned by the lever will be translated into a linear motion of the mobile member. If the contacting surfaces of the wedge-shaped member and the mobile member are tapered, the engagement can be made tighter than was possible with prior art method of attachment by means of bolts or screws.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
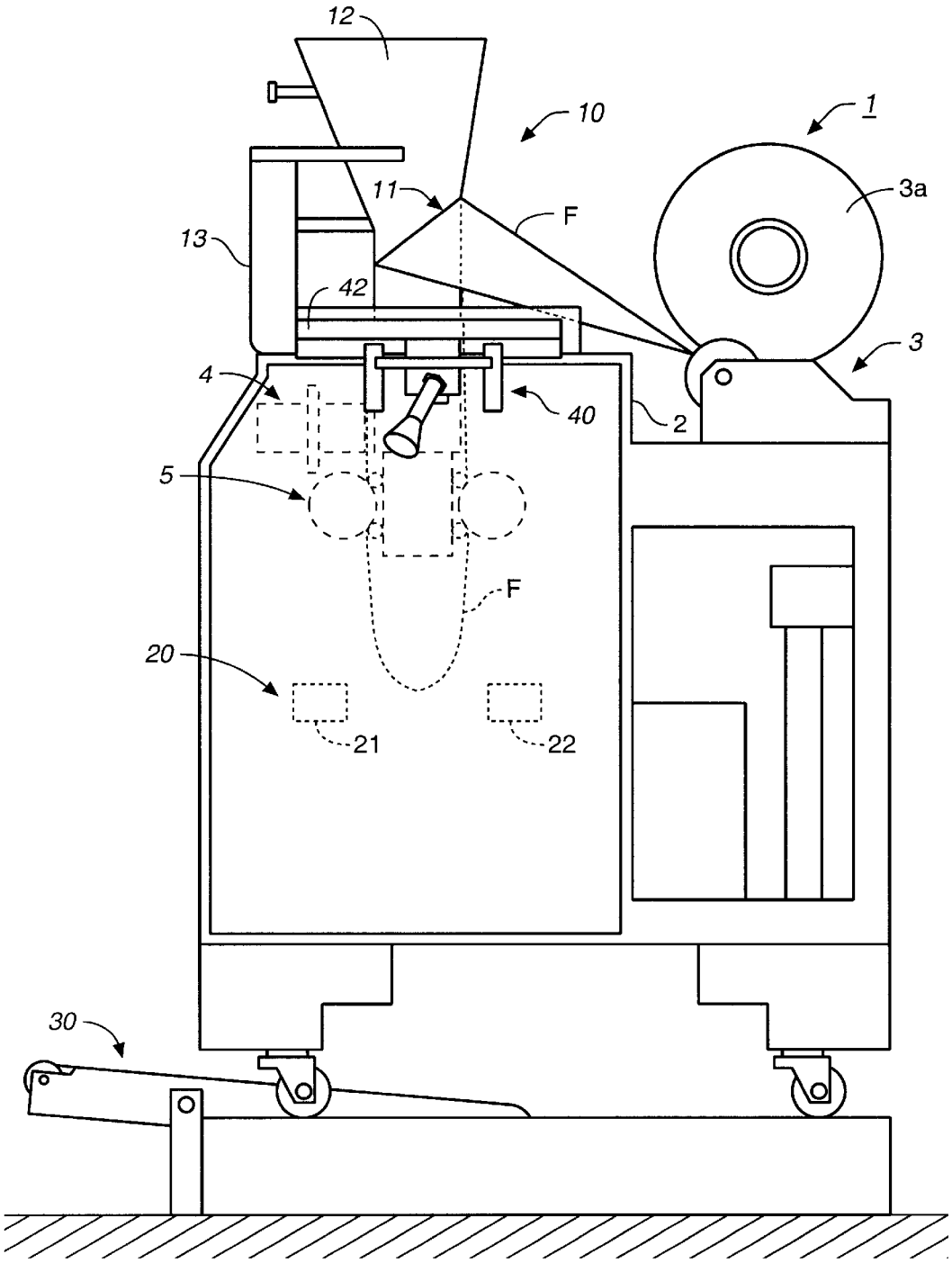
FIG. 1 is a right-hand side view of a packaging machine embodying this invention.

FIG. 1 shows a packaging machine 1 embodying this invention, having a box-shaped frame structure (the "frame") 2 behind which is provided a roll support section 3 supporting a film roll 3*a*. Above this box-shaped frame 2 are a former 11 and a chute 12. The former 11 is for bending an elongated bag-making material (the "film") F, being pulled out of the film roll 3*a*, into a tubular form such that its longitudinal side edges will overlap one on top of the other. The chute 12 is for allowing articles to be dropped into the tubularly formed film F. The former 11 and the chute 12 are formed as a unified structure, herein referred to as the former unit 10. Inside the box-shaped frame 2 near the top is a longitudinal sealer 4 for longitudinally sealing the tubularly formed film F along the mutually overlapping side edges. The longitudinal sealer 4 includes a heater motor (not shown) and a heater (not shown) adapted to be driven by this motor so as to be intermittently pressed against the mutually overlapping side edge parts of the tubularly formed film F.

Numeral 5 indicates a mechanism disposed below the former 11 and the longitudinal sealer 4 for pulling the film F. Although its structure will not be described in detail because many film-pulling mechanisms have been known, it may comprise receiver rollers disposed opposite the front and back surfaces at the bottom of the cylindrical chute 12, driver rollers for sandwiching front and back portions of the tubularly formed film F with the receiver rollers and a film-pulling motor (not shown) for causing the driver rollers to rotate in a specified direction such that the tubularly formed film F is transported downward inside the frame 2.

Only symbolically shown by numeral 20 is a transverse sealer with a pair of (front and back) sealing devices 21 and 22 sandwiching the tubularly formed film F transversely to the direction of its downward motion from the front and the back. On the back surface of the forwardly positioned sealing device 21 is a cross-sectionally U-shaped heater receiver (not shown) which is movable in the forward-backward direction. A cutter (not shown) is attached also to the back surface of the front sealing device 21. A pair of upper and lower heaters (not shown) both extending horizontally is provided on the front surface of the back sealing device 22 such that, when the two sealing devices 21 and 22 are moved towards each other with the tubularly formed film F in between, the front surfaces of the heaters contact the backwardly facing surfaces of the heater receiver and the tubularly formed film F is sealed transversely along two (upper and lower) horizontal lines while the cutter protrudes backward to cut the sealed film F transversely between these two lines.

In FIG. 1, numeral 30 indicates a conveyor disposed below the frame 2 for discharging finished packaged product in a forward direction.

In addition to the structures described above which may be considered common to other packaging machines of known types, the packaging machine 1 of this invention is provided with an attachment mechanism 40 for attaching the former unit 10 to the frame 2.

Figure 2:
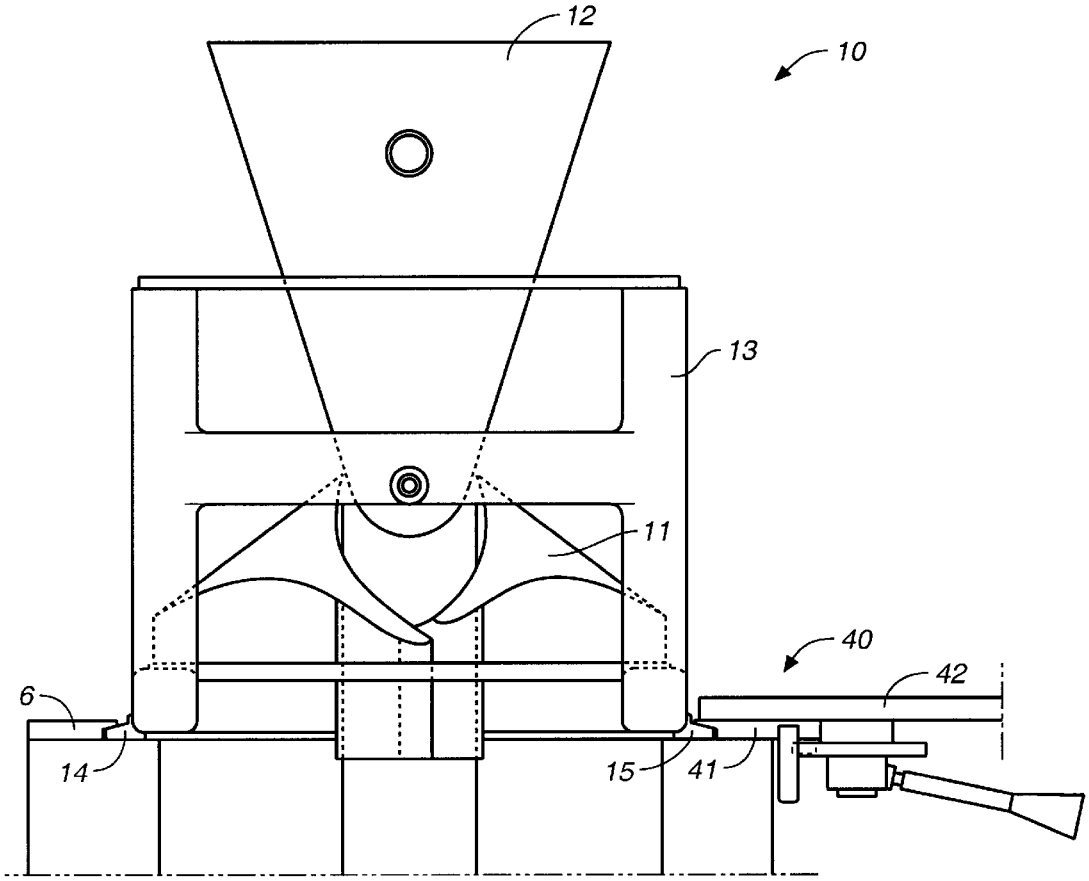
FIG. 2 is a front view of the former unit and its attachment mechanism shown in FIG. 1.

As shown in FIGS. 1 and 2, the former unit 10 has an attachment frame 13 which may be described as being L-shaped when seen from a side and to which both the former 11 and the chute 12 are attached. Wedge-shaped (left-hand and right-hand) pieces 14 and 15 with a tapered upper surface are each attached to the bottom side part of one of the legs of the former unit 10. A fixed engaging member 6 is correspondingly attached to the top of the frame 2 on the left-hand side as seen from the front of the packaging machine 1 and as shown in FIG. 2, forming a notch with the top surface of the frame 2 into which the left-hand wedge-shaped piece 14 engages. A mobile engaging member 41 is provided as a part of the attachment mechanism 40 and is disposed so as to form another notch with the top surface of the frame 2 and to engage the right-hand wedge-shaped piece 15 in this notch, as shown in FIG. 2.

Figure 3:
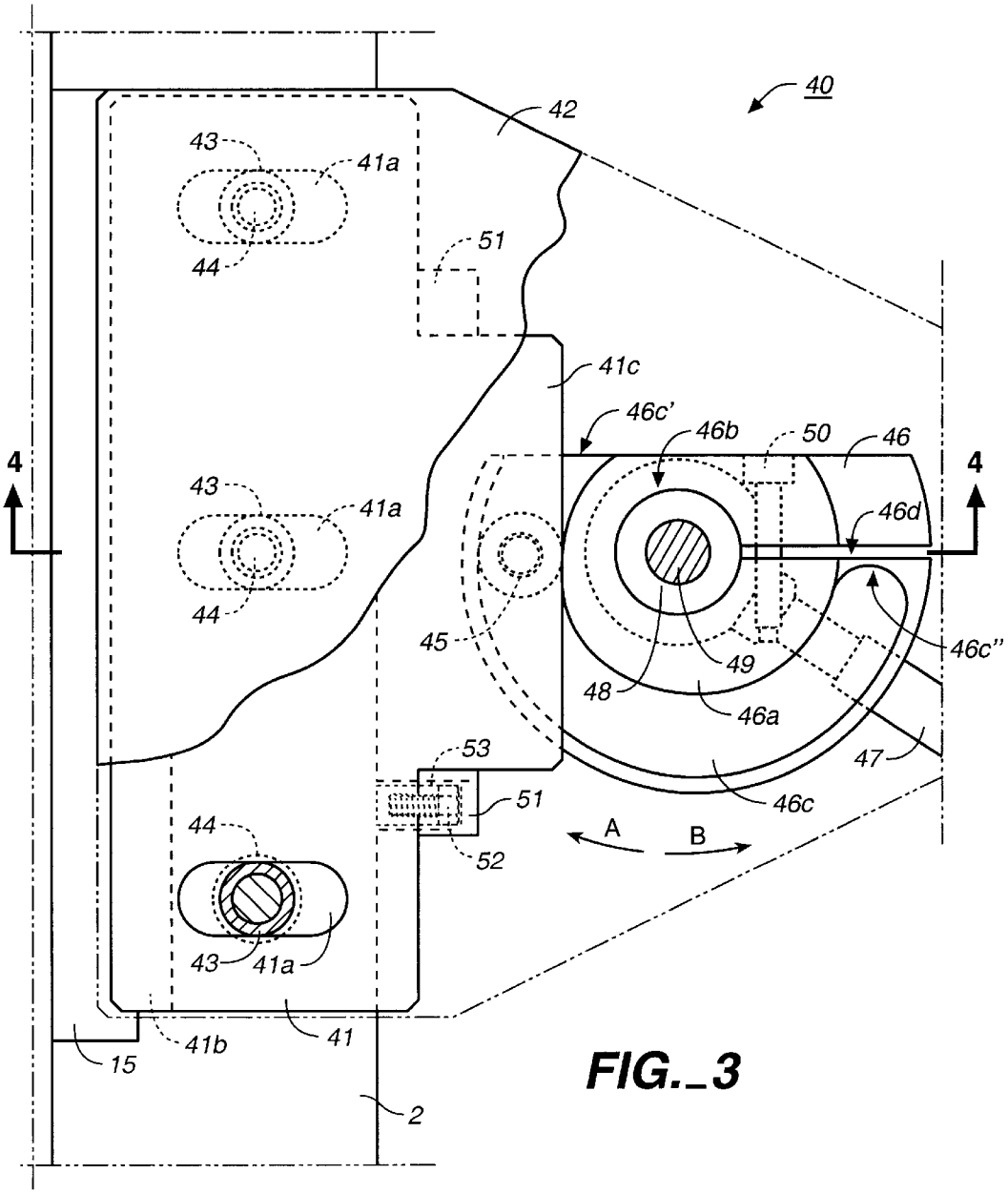
FIG. 3 is a plan view of the attachment mechanism for the former unit shown in FIG. 2 with a portion thereof removed.
Figure 4:
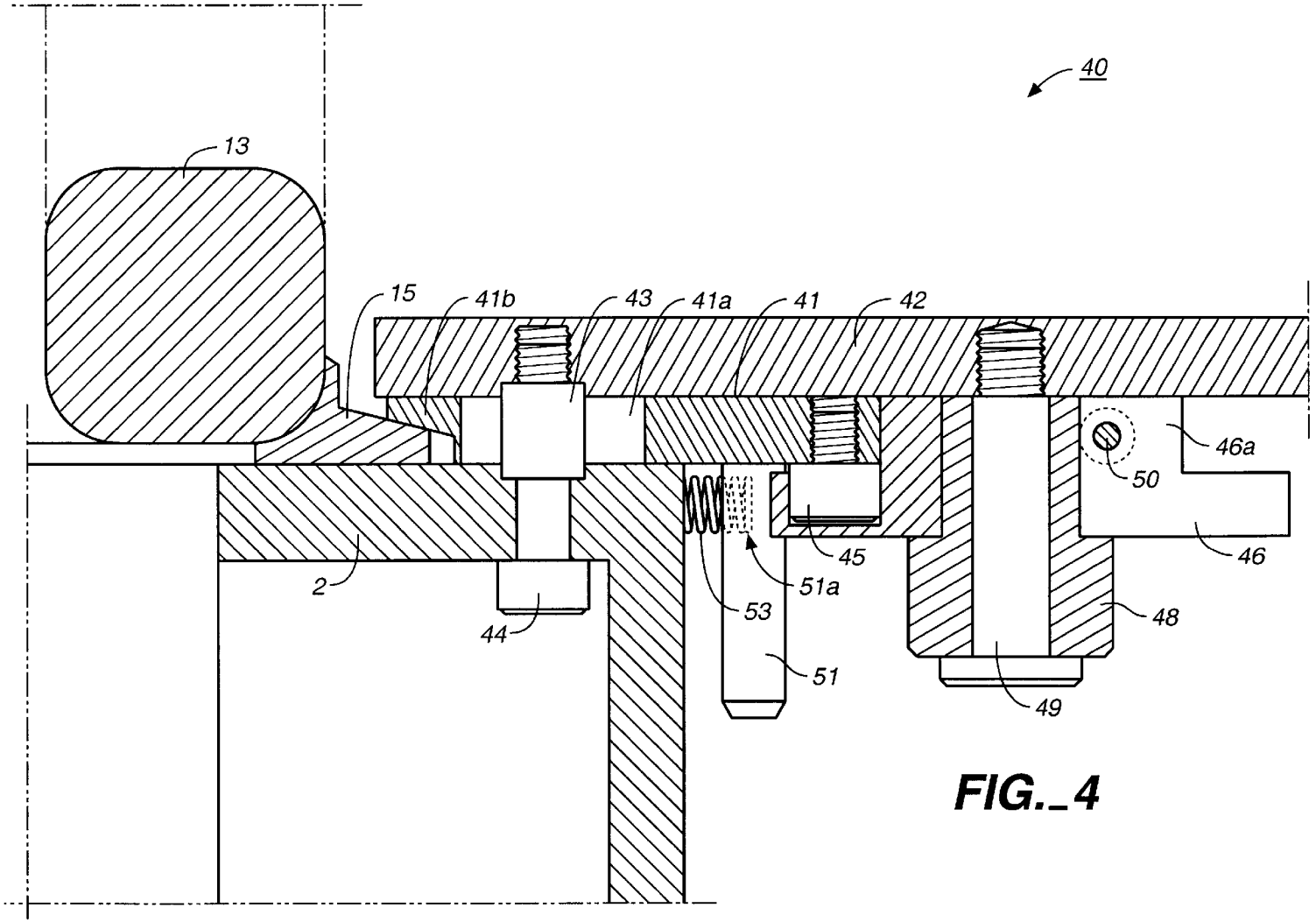
FIG. 4 is a sectional view of the attachment mechanism of FIGS. 2 and 3 taken along line 4—4 of FIG. 3.

The attachment mechanism 40 includes a cover 42 which extends parallel to the upper surface of the front part of the frame 2. As shown in FIGS. 3 and 4, three aligned indentations are formed at corresponding positions on the bottom surface of the cover 42 and the top surface of the frame 2, and three cylindrical members 43 are each inserted in a different one of the indentations in the cover 42 and the corresponding one of the indentations on the frame 2. Each of these cylindrical members 43 is vertically penetrated by a bolt 44 which is rotated so as to fasten the cover 42 to the frame 2 with a gap of a specified height left therebetween. The aforementioned mobile engaging member 41 is also provided with three elongated holes 41*a* at positions which correspond to those of three cylindrical members 43, the direction of elongation of these holes 41*a* being the left-right direction perpendicular to the direction in which these cylindrical members 43 are aligned. Thus, with the three cylindrical members 43 passing individually through the three holes 41*a*, the mobile engaging member 41 can be slid only to the left (or the "tightening direction") or to the right (or the "loosening direction) with respect to FIG. 3. Although not clearly visible in FIG. 2, FIG. 4 shows that the left-hand edge part 41*b* of the mobile engaging member 41 has a tapered bottom surface so as to tightly engage with the tapered upper surface of the right-hand wedge-shaped piece 15 described above.

As shown in FIG. 3, the mobile engaging member 41 has a protruding portion 41*c* extending to the right. A cam follower 45 is attached to the bottom surface of this protruding portion 41*c* of the mobile engaging member 41 so as to engage in a cam groove 46*c* formed in a cam member 46, provided on the right-hand side of the mobile engaging member 41, as well as a lever member 47 for causing the cam member to undergo a rotary motion. The cam member 46 has an upwardly protruding part 46*a* with a throughhole 46*b* penetrating vertically therethrough, the groove 46*c* curving around the protruding part 46*a*. The cam member 46 also has a slit 46*d* which reaches the throughhole 46*b*. The aforementioned lever member 47 is attached to a lever-attaching member 48. After this lever-attaching member 48 is fitted inside the throughhole 46*b* through the cam member 46, a bolt 49 through the lever-attachment member 48 is tightened such that the lever member 47, together with the lever-attaching member 48, is rotatably attached to the cover 42. Another bolt 50 is provided perpendicularly to the direction of the slit 46*d* such that the cam member 46 can be fastened to the lever-attaching member 48 by tightening this perpendicular bolt 50. In this manner, the cam member 46 can be caused to undergo a rotary motion together with the lever-attaching member 48 around the bolt 49.

Figure 5:
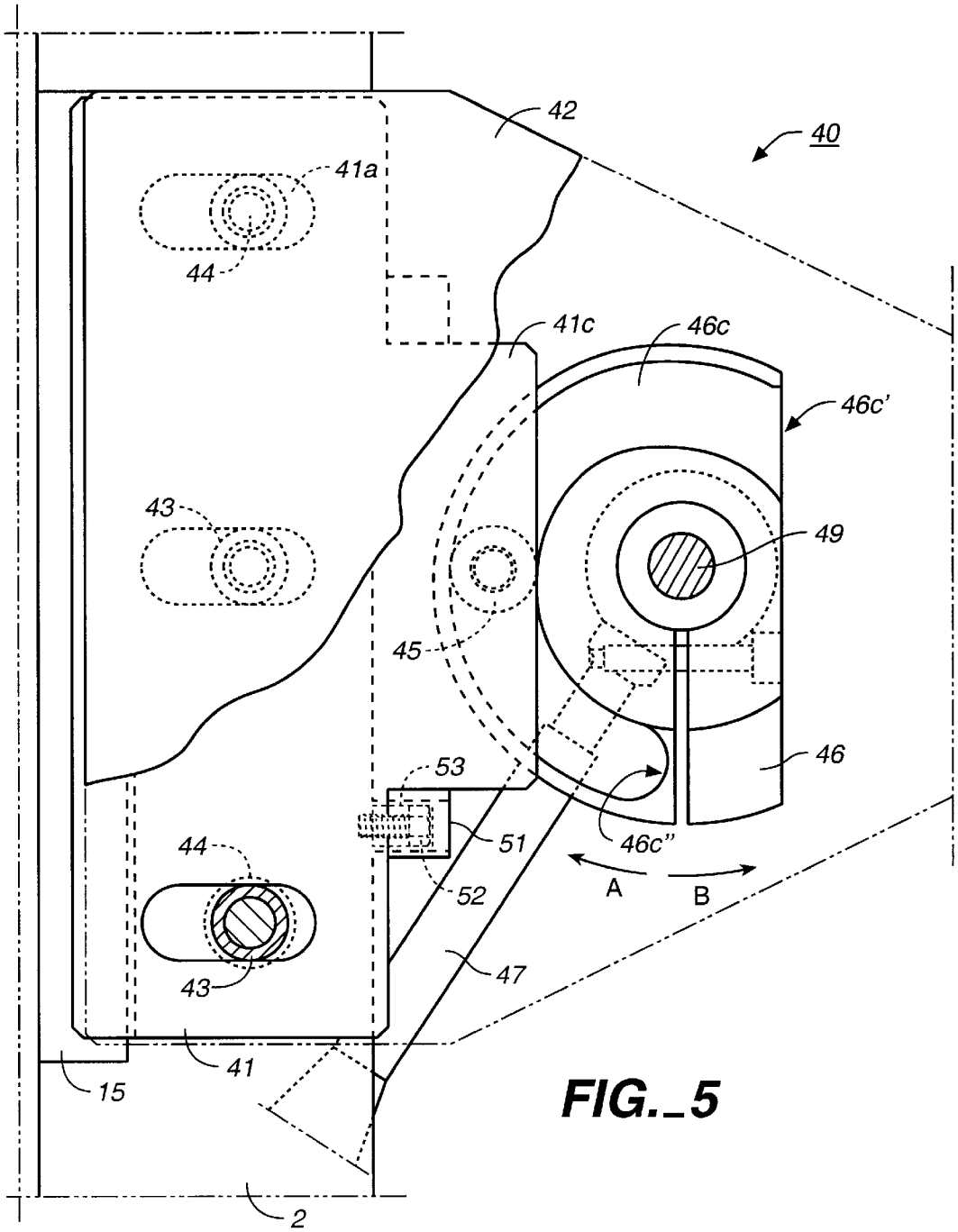
FIG. 5 is another plan view of the attachment mechanism for the former unit as shown in FIG. 3 after the lever member has been rotated in the clockwise direction.

The cam groove 46*c* has an open end 46*c*' through which the cam follower 45 can enter or leave the groove 46*c* and a closed end 46*c*" serving to limit the motion of the cam follower 45 inside the groove 46*c*. In between, the groove 46*c* is in a spiral form such that the distance of the cam follower 45 from the center of rotation of the cam member 46 will change only gradually. If the lever member 47 is rotated in the clockwise direction, as shown by arrow A in FIG. 3, the cam follower 45 moves inside the cam groove 46*c* in a relative sense from its open end 46*c*' toward its closed end 46*c*", as shown in FIG. 5. Because of the spiral shape of the groove 46*c* described above and because the mobile engaging member 41 is mobile only in the tightening and loosening directions, as explained above, the cam follower 45, and hence also the mobile engaging member 41, will then be shifted in the tightening direction.

As shown also in FIGS. 3 and 4, two stopper members 51 are attached to the mobile engaging member by means of bolts 52, on both sides of its protruding portion 41*c*. Each of these stopper members 51 is provided with an indentation 51*a* and similar indentations (not shown) are formed correspondingly on the frame 2, supporting compressed springs 53 between the frame 2 and the mobile member 41 with their ends received in these indentations. In other words, these springs 53 serve to apply a biasing force on the mobile member 41 in the loosening direction. Thus, when the former unit 10 is to be removed from the frame 2, the lever member 47 is rotated in the counterclockwise direction as shown by arrow B in FIG. 3. This will disengage the cam follower 45 from the cam groove 46*c* at its opening end 46*c*', and the biasing force of the springs 53 will push the mobile engaging member 41 automatically in the loosening direction. The closed end 46*c*" of the groove 46*c* serves to prevent excessive tightening by the operation of the lever member 47.

Next, the method of operation of the mechanism explained above will be described in detail.

Firstly, the wedge-shaped pieces 14 and 15 of the former unit 10 are engaged with the fixed and mobile engaging members 6 and 41. After the cam follower 45 on the mobile engaging member 41 is advanced into the cam groove 46*c* of the cam member 46 through its open end 46*c*', the lever member 47 is rotated in the direction of arrow A, causing the cam follower 45 to advance deeper into the cam groove 46*c* in the relative sense towards its closed end 46*c*". As a result, the mobile engaging member 41 is pushed in the tightening direction, thereby tightly engaging the wedge-shaped pieces 14 and 15 respectively with the fixed and mobile engaging members 6 and 41. Since these wedge-shaped pieces 14 and 15 and the engaging members 6 and 41 have tapered contact surfaces, the former unit 10 is thereby affixed tightly to the frame 2 not only in the horizontal direction but also in the vertical direction.

When removing the attached former unit 10, the user turns the lever member 47 in the direction of arrow B, causing the cam follower 45 to be released from the cam groove 46*c* at its open end 46*c*'. As the cam follower 45 is disengaged from the cam groove 46*c*, the biasing force of the compressed springs 53 automatically causes the mobile engaging member 41 to move away from the frame 2 in the loosening direction. This automatic pushing of the mobile engaging member 41 by the compressed springs 53 serves to reduce the required stroking motion on the lever member 47.

In summary, attachment and detachment of the former unit 10 can be effected very easily by a one-touch operation on the lever member 47. This serves to significantly improve the work efficiency of the packaging machine as a whole.

Figure 6:
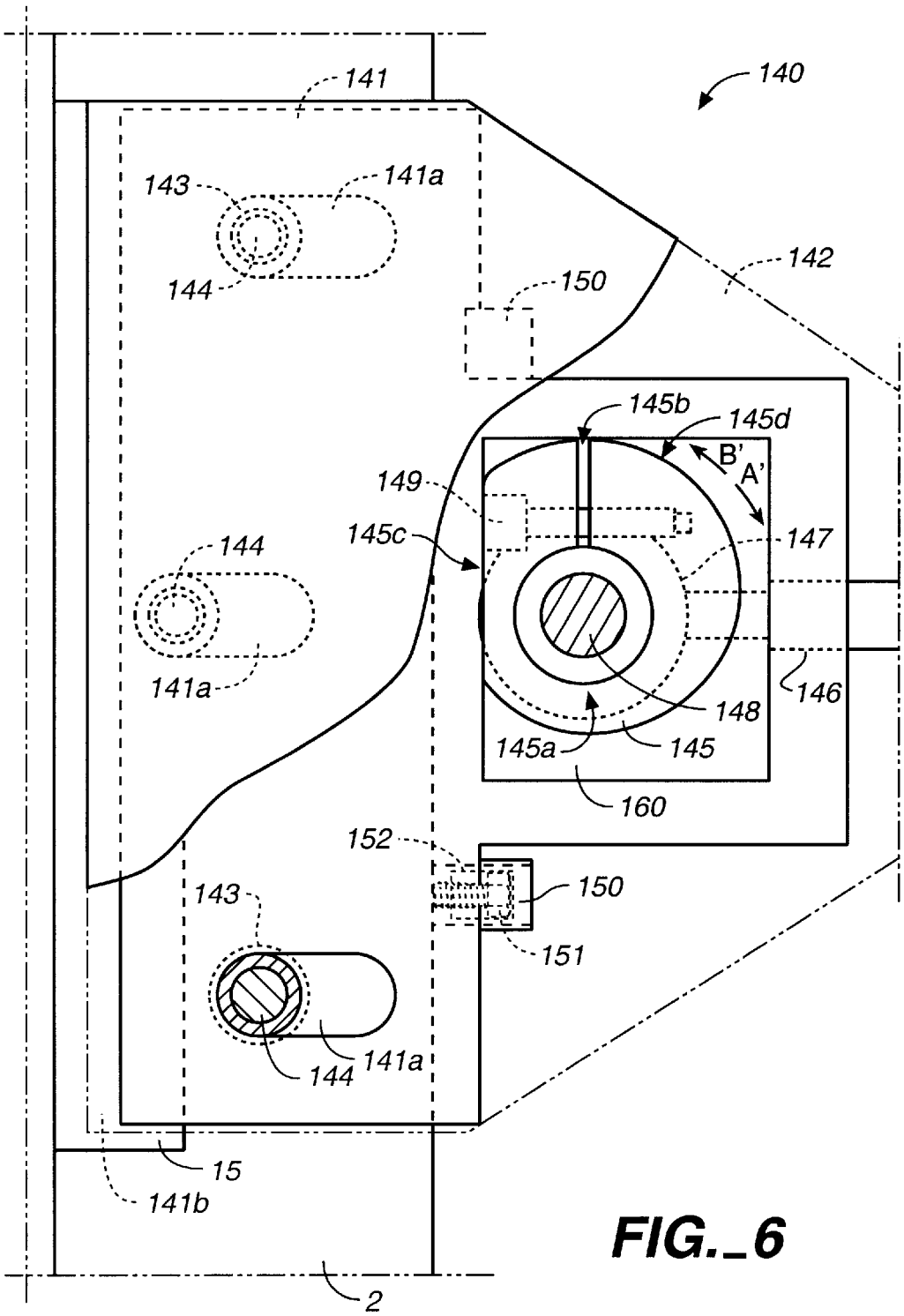
FIG. 6 is a plan view of a former unit and its attachment mechanism according to another embodiment of the invention with a portion thereof removed.
Figure 7:
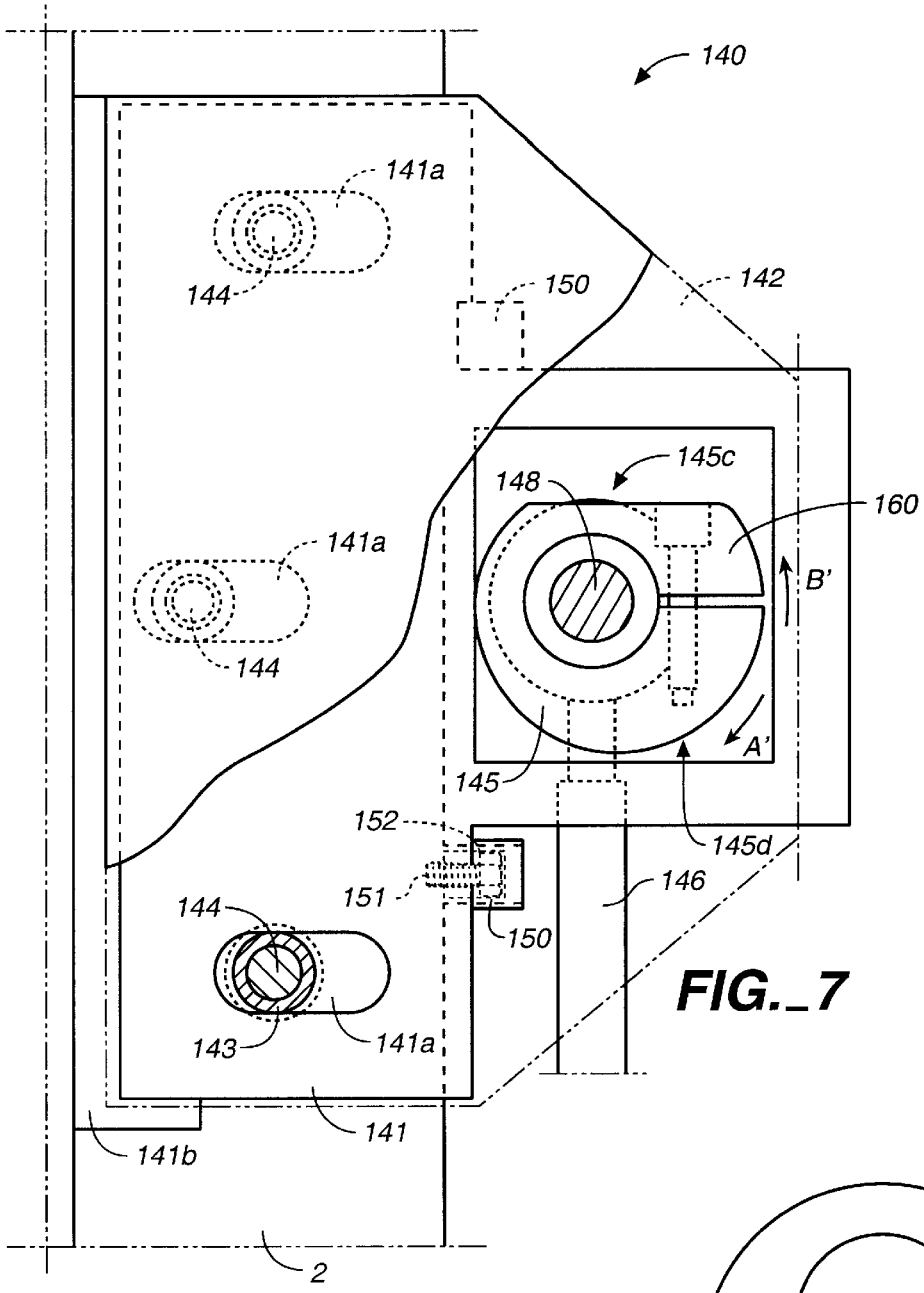
FIG. 7 is another plan view of the former unit and its attachment mechanism of FIG. 6 when the lever member has been rotated in the clockwise direction.

Another packaging machine according to another embodiment of the invention will be described next with reference to FIGS. 6 and 7. Since the second embodiment is largely similar to the first embodiment of the invention shown above with reference to FIGS. 1–5, like components will be indicated by the same numerals such as the frame 2 and will not be repetitively described. FIGS. 6 and 7 show another former unit attachment mechanism 140. Since this mechanism 140, too, is similar to the mechanism 40 described above, only the aspects which are different will be explained in detail.

The attachment mechanism 140 has a cover 142 and a mobile engaging member 141 which has a rectangular window 160 and is attached to the cover 142 so as to be movable only in the "tightening" and "loosening" directions as defined above. The mechanism for attaching the mobile engaging member 141 to the cover 142 is the same as the way the mobile engaging member 41 is attached to the cover 42. Thus, the components for this mechanism are indicated in FIGS. 6 and 7 by three-digit numerals such as 141*a*, 141*b*, 143, 144 of which the lower two digits are the same as the numerals indicating the equivalent components in FIGS. 3, 4 and 5 such as 41*a*, 41*b*, 43 and 44, and will not be repetitively explained. It is to be noted, in comparing the attachment mechanisms 40 and 140, that the three cylindrical members 143 and the three elongated holes 141*a* are not aligned, as shown in FIGS. 6 and 7, unlike the corresponding cylindrical members 43 and elongated holes 41*a* shown in FIGS. 3 and 5. This non-linear arrangement is preferable for providing more secure attachment.

Instead of the cam member 46 shown in FIGS. 3, 4 and 5, the mechanism 140 is provided with a rotary member 145 which is positioned inside the window 160 of the mobile engaging member 141 and is adapted to slide against it. The rotary member 145 has a throughhole 145*a* at its center and a slit 145*b* extending radially to reach this throughhole 145*a*. A lever-attaching member 147, to which a lever member 146 is attached, is engaged inside this throughhole 145*a*, with the tightening of a vertically oriented center bolt 148 such that the lever member 146 and the lever-attaching member 147 are attached rotatably to the cover 142. Another bolt 149 is provided across the slit 145*b* such that the rotary member 145 can be fastened to the lever-attaching member 147 by turning this bolt 149. Thus, the rotary member 145 is rotatable with the lever-attaching member 147 around the center bolt 148. This is similar to the way the leverattaching member 48 is fastened to the cam member 46 shown in FIGS. 3, 4 and 5.

The side wall of the rotary member 145 has a planar portion 145*c* and a curved portion 145*d*. The curvature of the curved portion 145*d* of the side wall varies such that the distance of the side wall from the center of rotation of the rotary member 145 will gradually increase in the counterclockwise direction. Thus, if the lever member 146 is rotated in the clock-wise direction as indicated by arrow A' in FIG. 6, the curved portion 145*d* of the side wall of the rotary member 145 pushes the left-hand side inner wall of the window 160 of the mobile member 141, and since the mobile member 141 is supported so as to be mobile only linearly, it is shifted in the tightening direction, or to the left with respect to FIG. 6.

With reference still to FIGS. 6 and 7, two stopper members 150 are attached from both sides to the rotary member 145 on the mobile engaging member 141 by means of bolts 151. Each of these stopper members 150 is provided with an indentation (not shown) and similar indentations (not shown) are formed correspondingly on the frame 2, supporting compressed springs 152 between the frame 2 and the mobile engaging member 141 with their ends received in these indentations. In other words, these springs 152 serve to apply a biasing force on the mobile engaging member 141 in the loosening direction. This is also similar to the way the springs 53 of FIGS. 3, 4 and 5 are supported between the stopper members 51 and the frame 2.

Thus, if the lever member 146 is rotated in the counterclockwise direction as indicated by arrow B' in FIG. 7, the right-hand side inner wall of the window 160 of the mobile engaging member 141 is pushed in the loosening direction, being pushed by the side wall of the rotary member 145. This will disengage the former unit 10, making it removable from the frame 2. As the springs 53 of FIGS. 3, 4 and 5 serve to reduce the stroking motion on the lever member 47 when the former unit 10 is to be released, the springs 152 of FIGS. 6 and 7 serve to move the mobile engaging member 141 in the loosening direction. It may also be remarked in this connection that means may be provided so as not to rotate the lever member 146 excessively in the clockwise direction in order to prevent excessive tightening of the mobile engaging member 141.

Next, the method of operation of the mechanism according to the second embodiment of the invention explained above will be described in detail.

Firstly, the wedge-shaped pieces 14 and 15 of the former unit 10 are engaged with the fixed and mobile engaging members 6 and 141. Next, the lever member 146 of the attachment mechanism 140 is rotated in the clockwise direction such that the mobile engaging member 141 moves in the tightening direction. When the mounted former unit 10 is to be removed, the lever member 146 is rotated in the counter-clockwise direction, disengaging the wedge-shaped pieces (as shown at 14 and 15 in FIGS. 2 and 4) from the corresponding fixed engaging member and the edge part (respectively shown at 6 and 41*b* in FIGS. 2 and 4) and then allowing the biasing force of the springs 152 to move the mobile engaging member 141 in the loosening direction. In summary, according to the second embodiment of this invention, too, attachment and detachment of the former unit 10 can be effected very easily by a one-touch operation on the lever member 146, and this serves to significantly improve the work efficiency of the packaging machine as a whole.

Figure 8:
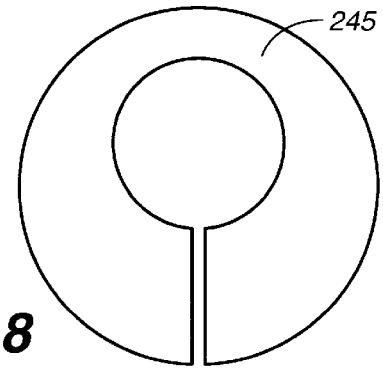
FIG. 8 is a plan view of another rotary member for the attachment unit embodying this invention.
Figure 9:
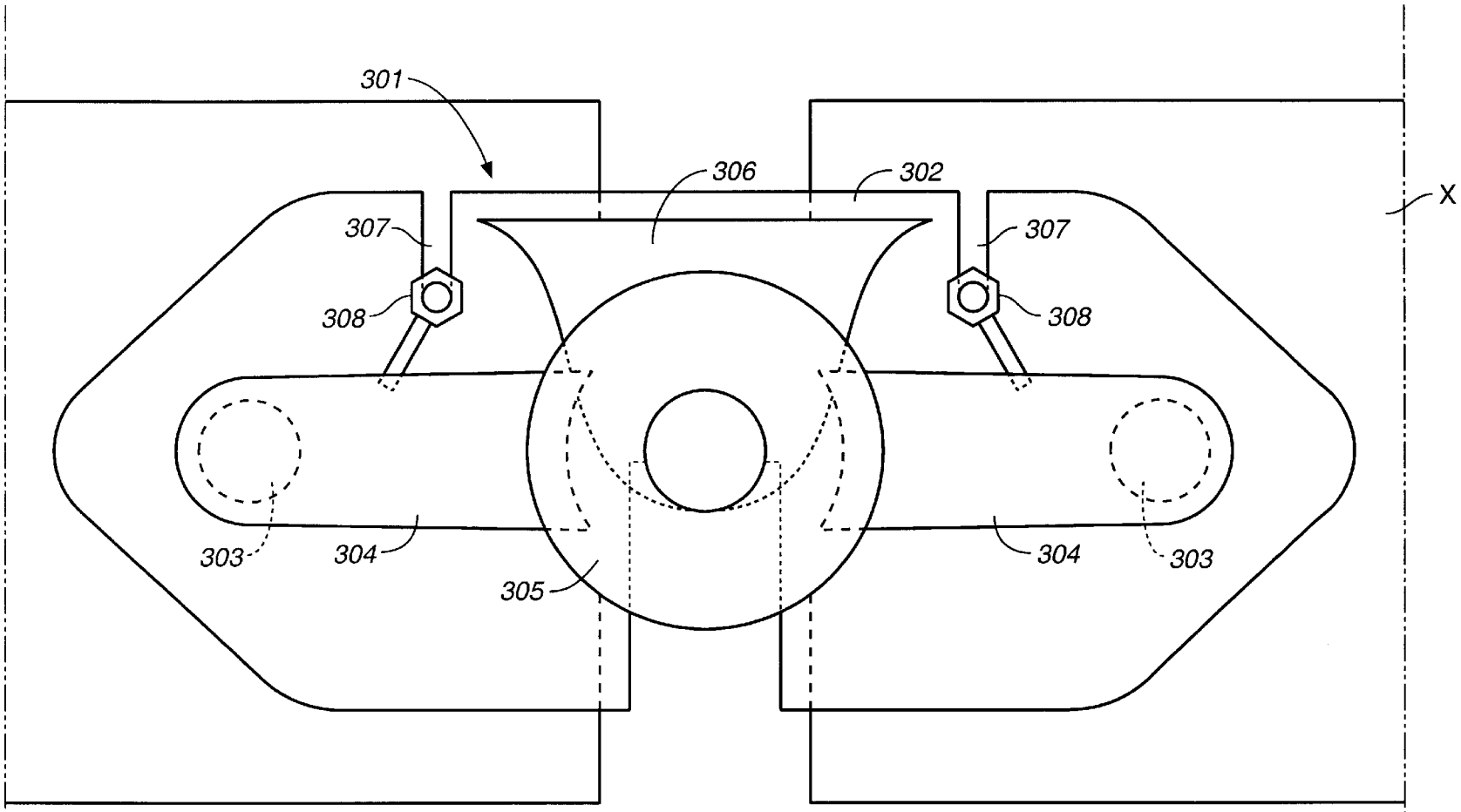
FIG. 9 (PRIOR ART)
FIG. 9 is a schematic plan view of a prior art mechanism for attaching a former unit to a packaging machine.

The invention was described above by way of a limited number of examples but these examples are not intended to limit the scope of the invention. Many modifications and variations are available within the scope of the invention. For example, the rotary member 145 shown in FIGS. 6 and 7 with the side wall having both a planar portion 145*c* and a curved portion 145*d* may be replaced by another rotary member 245 as shown in FIG. 8 with a circular planar shape and an eccentrically provided circular opening through which the center bolt 148 is passed and attached to the lever attaching member 147. The rotary member 245 thus designed is advantageous because it is easier to produce.

Among the advantages to be gained by the present invention is the ease with which the former unit can be attached and detached by a one-touch operation on a lever member. Screws and bolts for attaching the former unit to the packaging machine frame tend to become contaminated. Since no screws or bolts are required according to this invention for the attachment of the former unit, this invention may also be said to improve the sanitary condition of the packaging machine. The cam follower and the cam groove may become contaminated by dust and oil substances but the motion of the cam follower inside the groove will not be adversely affected. Since the attachment is effected between two tapered surfaces, furthermore, the former unit can be even more firmly fastened to the machine frame than by prior art technologies relying on bolts or screws.

What is claimed is:

1. A packaging machine comprising:

a frame structure supporting film transporting means for transporting an elongated film longitudinally;

a former unit integrating a former for bending the film into a tubular form and a chute through which articles to be packaged are dropped, said former unit having wedge-shaped members;

a longitudinal sealer for sealing side edges of the tubularly formed film longitudinally;

a transverse sealer disposed below said longitudinal sealer for transversely sealing the longitudinally sealed film to form a bag; and an attachment mechanism for detachably attaching said former unit to said frame structure, said attachment mechanism including a mobile member, a lever which is rotatably attached to said frame structure, and a cam mechanism for converting a rotary motion of said lever into a linear motion of said mobile member, said linear motion causing said mobile member to engage with or disengage from said wedge-shaped members of said former unit, thereby attaching or detaching said former unit to or from said frame structure.

2. The packaging machine of claim 1 wherein said mobile member is connected to said frame structure so as to be slidable with respect to said frame structure only in one direction defined by said linear motion.

3. The packaging machine of claim 2 wherein said cam mechanism includes a cam plate and a cam follower, said lever serves to rotate said cam plate, said cam follower is attached to said mobile member, and said cam mechanism serves to cause said mobile member to move linearly either in a tightening or loosening direction so as to correspondingly either engage or disengage said mobile member with or from said wedge-shaped members.

4. The packaging machine of claim 3 wherein said cam plate is provided with a groove in a spiral for and said cam follower moves inside and along said groove.

5. The packaging machine of claim 2 wherein said cam mechanism includes a cam plate positioned inside a window formed in said mobile member and said lever serves to rotate said cam plate so as to cause said cam plate to contact an inner wall of said window in said mobile member and to thereby cause said linear motion of said mobile member.

6. The packaging machine of claim 5 wherein said cam plate is completely circular.

7. The packaging member of claim 1 wherein said wedge-shaped members contact said mobile member through tapered surfaces.

* * * * *